US005200048A

United States Patent [19]

Tanaka et al.

[11] Patent Number: 5,200,048

[45] Date of Patent: Apr. 6, 1993

[54] ELECTROPLATING APPARATUS FOR PLATING HALF BEARINGS

[75] Inventors: Tadashi Tanaka, Konan; Masaaki Sakamoto, Nagoya; Motomu Wada, Owariasahi; Hideo Ishikawa, Komaki, all of Japan

[73] Assignee: Daido Metal Company Ltd., Tokyo, Japan

[21] Appl. No.: 888,699

[22] Filed: May 27, 1992

Related U.S. Application Data

[62] Division of Ser. No. 618,796, Nov. 28, 1990.

[30] Foreign Application Priority Data

Nov. 30, 1989 [JP] Japan ..... 1-309197

[51] Int. Cl.[5] ..... C25D 17/06

[52] U.S. Cl. ..... 204/297 W; 204/297 R; 204/287; 204/275

[58] Field of Search ..... 204/297 W, 297 R, 287, 204/275; 118/423, 427

[56] References Cited

U.S. PATENT DOCUMENTS

| | | | |
|---|---|---|---|
| 1,725,877 | 8/1929 | Maag | 204/297 W |
| 2,500,206 | 3/1950 | Schaefer et al. | 204/297 W |
| 2,697,690 | 12/1954 | Beebe | 204/297 W |
| 2,727,858 | 12/1955 | Klein | 204/297 W |
| 4,065,378 | 12/1977 | Sauer et al. | 204/297 W |
| 4,069,131 | 1/1978 | Beck et al. | 204/297 W |
| 4,259,166 | 3/1981 | Whitehurst | 204/279 |
| 4,599,147 | 7/1986 | Thompson | 205/122 |
| 4,643,816 | 5/1987 | Geels | 204/228 |

FOREIGN PATENT DOCUMENTS

| | | |
|---|---|---|
| 45-20362 | 7/1970 | Japan . |
| 1332568 | 5/1971 | United Kingdom . |
| 1431113 | 10/1973 | United Kingdom . |
| 1422497 | 3/1974 | United Kingdom . |
| 2007259A | 10/1978 | United Kingdom . |
| 2007259B | 10/1978 | United Kingdom . |
| 2102836A | 6/1982 | United Kingdom . |

*Primary Examiner*—John Niebling
*Assistant Examiner*—Kishor Mayekar
*Attorney, Agent, or Firm*—Browdy and Neimark

[57] ABSTRACT

There is disclose a method of and apparatus for surface-treatment of half sliding bearings having a multi-layer construction including a steel backing, a bearing alloy layer of copper alloy or aluminum alloy, an intermediate plating layer and a surface layer. A plurality of half sliding bearings are attached to a support member in such a manner that the half sliding bearings are arranged end-to-end into a semi-cylindrical configuration. The support member is transferred to be sequentially inserted into a plurality of openable and closable plating cases mounted respectively within pretreatment tanks and plating tanks, thereby sequentially forming the intermediate plating layer and the surface layer on the half sliding bearings.

1 Claim, 3 Drawing Sheets

ELECTROPLATING APPARATUS FOR PLATING HALF BEARINGS

This is a division of application Ser. No. 07/618,796, field Nov. 28, 1990.

BACKGROUND OF THE INVENTION

This invention relates to a method and apparatus for the surface treatment for half bearings used for a split type sliding bearings.

In one conventional method of plating half sliding bearings, as disclosed in Japanese Patent Examined Publication No. 45-20362, these half sliding bearings are arranged into a semi-cylindrical configuration, and two such arrays of half sliding bearings are mated together to form a cylindrical arrangement, and an anode is mounted at the center of this cylindrical arrangement so as to apply plating thereto. In another method and apparatus as disclosed in U.S. Pat. Nos. 2,500,206 and 2,697,690, half sliding bearings are arranged into a semi-cylindrical configuration, and a box-like plating case having a slit is attached to the inner surface of this semi-cylindrical arrangement, and then plating is applied.

However, the above conventional techniques have problems when at least two different kinds of platings are to be applied. More specifically, in the former conventional technique, it is necessary to exchange the anode depending on the kind of plating, and this conventional technique is not suited for a continuous treatment by an automatic plating apparatus. In the latter conventional technique, since the box-like plating case must be transferred into two kinds of plating tank, the plating apparatus is increased in size, and another problem is that because of the transfer of the plating case, a plating solution is much brought out of the plating tank.

SUMMARY OF THE INVENTION

It is therefore an object of this invention to provide a method of and apparatus for the surface treatment of half sliding bearings which method and apparatus overcome the above problems of the prior art.

According to one aspect of the present invention, there is provided a method of surface-treatment of half sliding bearings of a multi-layer construction including a steel backing, a bearing alloy layer of copper alloy or aluminum alloy, an intermediate plating layer and a surface layer, the method comprising the steps of:

attaching a plurality of half sliding bearings to a support member in such a manner that the half sliding bearing are arranged end-to-end into a semi-cylindrical configuration; and subsequently transferring the support member, which supports the half sliding bearings, so as to sequentially insert the support member into a plurality of openable and closable plating cases mounted respectively within pretreatment tank and plating tank, thereby sequentially forming the intermediate plating layer and the surface layer on the half sliding bearings.

According to another aspect of the invention, there is provided apparatus for surface-treatment of half sliding bearings, comprising:

a plurality of plating tanks;

a plurality of plating cases each mounted within each of the plurality of plating tanks, respectively, each of the plating cases including a front abutment plate for facing inner surfaces of the half sliding bearings, and a rear abutment plate for facing rear surfaces of the half sliding bearings, the front abutment plate having a slit and a shield plate, the front and rear abutment plates being connected together at their one ends by a hinge;

an opening and closing device operatively connected to the other ends of the front and rear abutment plates so as to move the front and rear abutment plates toward and away from each other about the hinge to close and open the plating case; and a support member for supporting the half sliding bearings in such a manner that the half sliding bearings are arranged end-to-end into a semi-cylindrical configuration; the support member supporting the half sliding bearings being inserted into the plating case when the plating case is in its open condition.

The support member supporting the half sliding bearings arranged in the semi-cylindrical configuration is inserted into the openable and closable box-like plating case mounted within each of the plating tank. There are provided separate DC power sources used respectively for the inner surfaces and rear surfaces of the half sliding bearings. The plating of the inner surfaces or the plating of the rear surfaces is carried out in the first plating tank, and the plating of the inner surfaces and/or the plating of the rear surfaces are carried out in the second plating tank. With this method, the plating can be applied only to the inner surfaces of the half sliding bearings, or the uniform plating layer can be applied to the inner and outer surfaces in such a manner that the thickness of the plating layer on the inner surface is different from that of the plating layer on the rear surface. Thus, with this method, the above problems of the prior art are overcome. Namely, the transfer of the half bearings into each of the plating tanks can be effected merely by transferring the support member supporting these half bearings, and the openable and closable construction of the plating case overcomes the above problems of the prior art. The plating case also enables the uniform plating to be formed only on the inner surfaces of the half bearings. Without this plating case, the distribution of the thickness of the plating layer on the inner surfaces would be improper.

DETAILED DESCRIPTION OF THE PREFERRED EMBODIMENT

A preferred embodiment of the invention will now be described in further detail with reference to the drawings.

Figure 1:
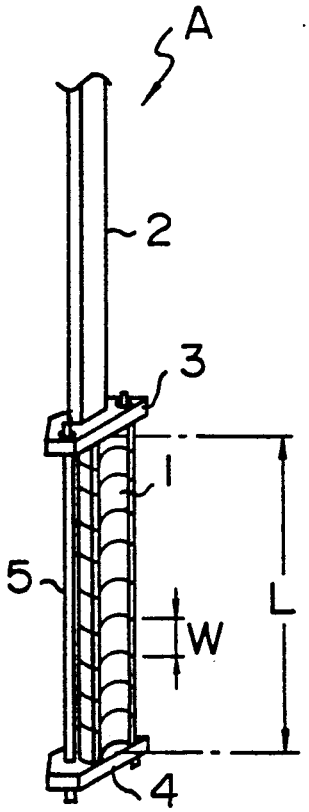
FIG. 1 is a perspective view of a support member.

FIG. 1 shows a support member A on which half sliding bearings 1 are arranged end-to-end into a semi-cylindrical configuration. Plating is applied to the inner surfaces or both of the inner and rear surfaces of the half bearings 1. Two rods 5 and 5 are extended between an upper electrically-conductive plate 3 and a lower electrically-insulative plate 4, and the distance between the two plates 3 and 4 is adjusted, so that the half bearings 1 are arranged or arrayed into a semi-cylindrical configuration between the two plates 3 and 4, and are clamped between the two plates 3 and 4. The conductive plate 3 is electrically insulated from each rod 5 by a non-conductive bushing and a non-conductive washer. Electric current is supplied to the half bearings 1 from a hanger (not shown) via a lead 2 and the conductive plate 3. The dimensions of the half bearing 1 to be attached to the support member A are not particularly limited; however, in view of warp and twist resulting from the stacking of the bearings one upon another, in the case where the bearing is used for an automobile, the width W of the bearing is 15 to 30 mm, and the height L of the support member is 250 to 600 mm. In the case where the bearing is used for a ship, the height L of the support member is 1,500 mm.

Figure 2:
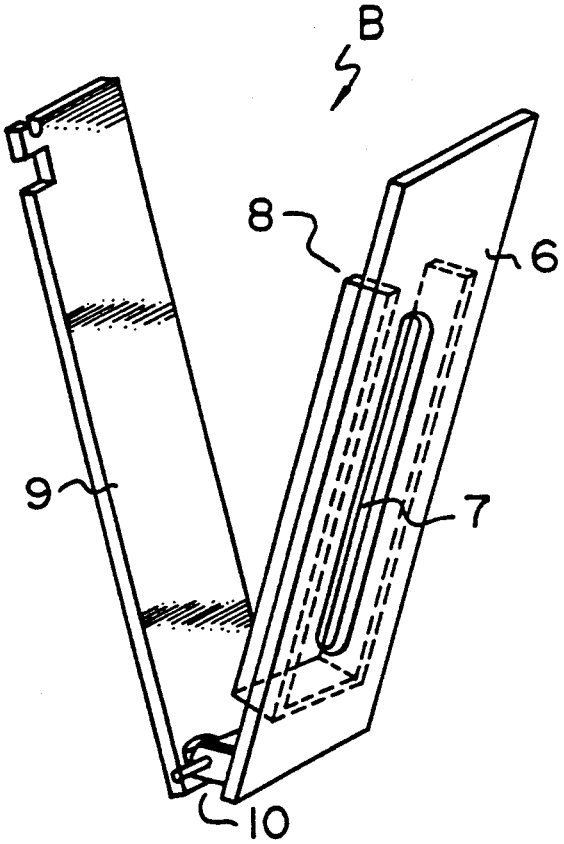
FIG. 2 is a perspective view of a plating case.

FIG. 2 shows a plating case B mounted in each of first and second plating tanks. This plating case B comprises an abutment plate 6 for facing the inner surfaces of the bearings 1, and has a slit (window) 7 formed through a central portion of the abutment plate 6. The slit 7 enables the plating to be applied to the inner surfaces of the bearings, and also enables energization and an agitation of a plating bath. A shield plate 8 electrically shields the opposite sides and lower portion of the bearings 1. An abutment plate 9 for facing the rear surfaces of the bearings is connected by a hinge 10 to the abutment plate 6, so that the two abutment plates 6 and 9 can be moved toward and away from each other. Namely, rods 11A and 11B of an opening and closing device 100 mounted on the upper portion of each of the plating tanks are connected at their one ends to the upper ends of the two abutment plates 6 and 9, respectively, so that the two abutment plates 6 and 9 are moved toward and away from each other about the hinge 10 to close and open the plating case B (as indicated by arrows), by the operation of the rods 11A and 11B. The opening and closing device 100 comprises a cylinder 20 having a compressed-air introducing pipe 24 and a compressed-air discharging pipe 25, a piston 19 slidably received in the cylinder 20, a piston rod 18 fixedly connected to the piston 19, a rod R1 and a gear G1 connected to the piston rod 18 via a pin 17, a gear G2 in mesh with the gear G1, a rod $R_{2A}$ connected to a shaft of the gear G2, a rod $R_{2B}$ connected to a shaft of the gear G1, the rod 11A connected between the upper end of the abutment plate 6 and the rod $R_{2B}$, and the rod 11B connected between the upper end of the abutment plate 9 and the rod $R_{2A}$. The piston 19 is moved by introducing the compressed air via the pipe 24 or by discharging the compressed air via the pipe 25, so as to angularly move the gears G1 and G2, so that the rods 11A and 11B are moved to move the abutment plates 6 and 9 toward and away from each other to close and open the plating case B. The length of the slit 7 is equal to the height L of the support member A, and preferably the width of the slit 7 is 10 to 30% of the inner diameter of the half sliding bearing. Preferably, the shield plate 8 is made of a material which will not react with the plating solution and has a relatively high strength. Examples of such material are FRP, PVC and PP. The height of the shield plate 8 is substantially equal to the height of a hinge support projection, and in the closed condition of the plating case B, the shield plate 8 is abutted against the abutment plate 9. A rubber packing may be mounted on the abutment edge of the shield plate 8. Preferably, the abutment plates 6 and 9 are made of the same material as that of the shield plate 8.

Figure 3:
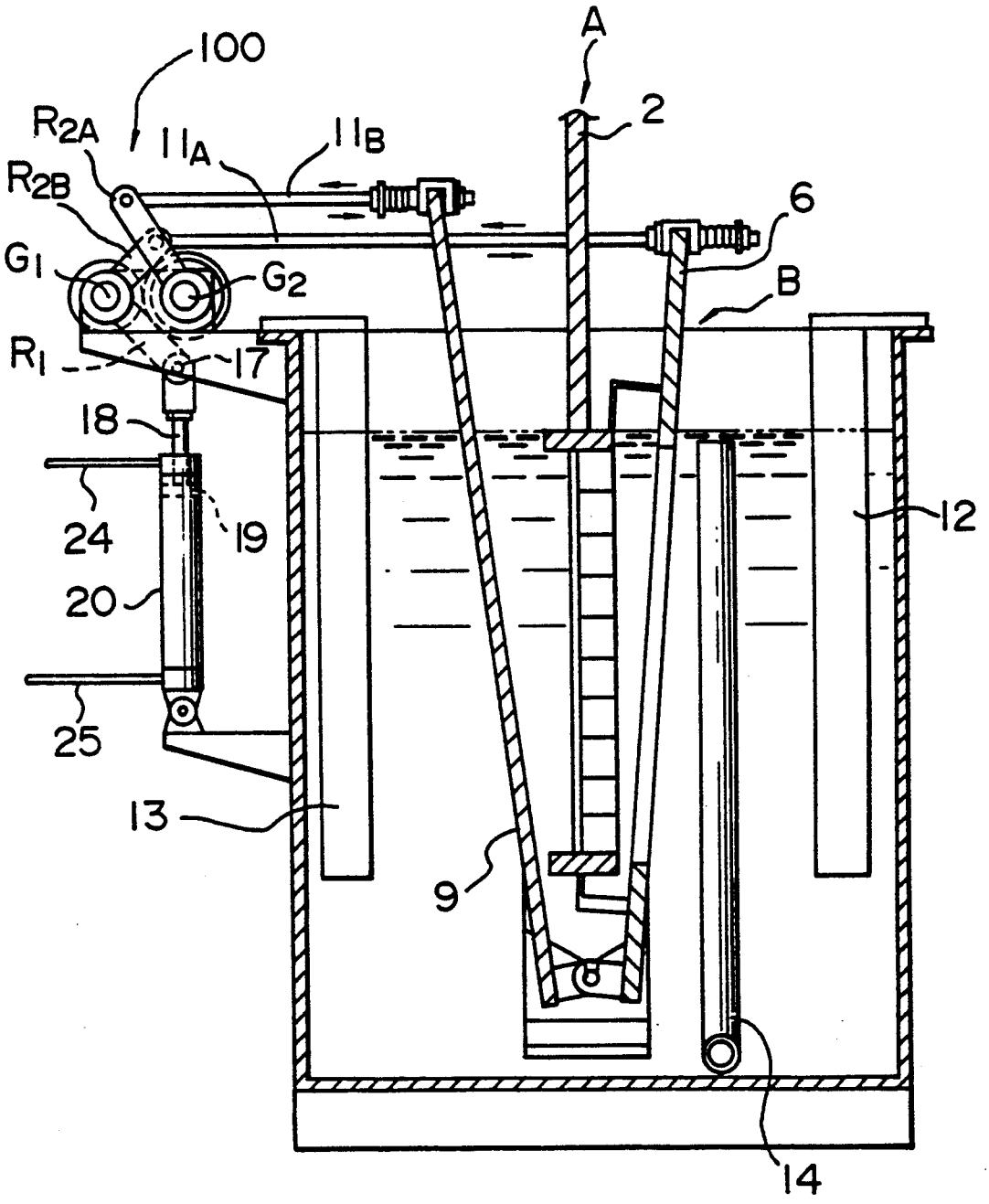
FIG. 3 is a partly cross-sectional view of the overall construction of a surface treatment apparatus of the invention, showing the manner in which the support member with half sliding bearings is being received in the plating case.

FIG. 3 shows a condition in which the half bearings arranged in a semi-cylindrical configuration as shown in FIG. 1 is being received in the plating case B after the bearings are transferred by a carrier or the like. As described above, the rods 11A and 11B are provided for moving the upper ends of the two abutment plates 6 and 9 toward and away from each other.

When the support member A supporting the half bearings arranged in a semi-cylindrical configuration is to be introduced into and removed from the plating tank, the two abutment plates 6 and 9 are in an open condition so as to facilitate such introduction and removal. An anode 12 for the inner surfaces of the half bearings and an anode 13 for the rear surfaces of these bearings are energized by independent DC power sources, respectively. Reference numeral 14 denotes an agitating liquid-injecting pipe having holes having a diameter of 2 to 4 mm, these holes being spaced a pitch of 10 to 30 mm from one another along the slit 7.

Figure 4C:
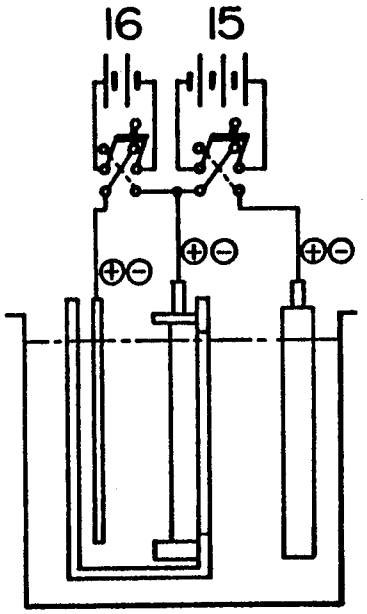
FIGS. 4(*a*), 4(*b*) and 4(*c*) are views illustrative of power supply arrangements used when applying plating to the half bearings.
Figure 4B:
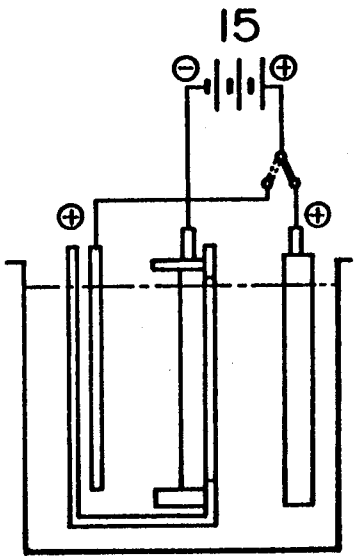
Figure 4A:
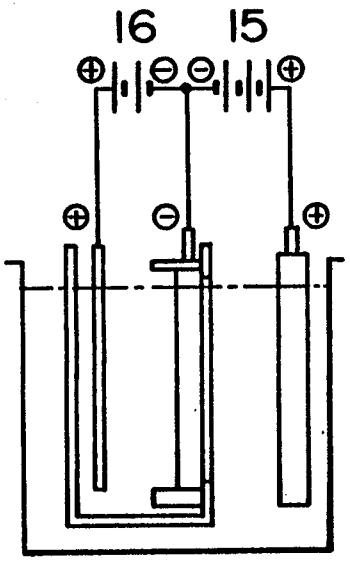

FIGS. 4(*a*), 4(*b*) and 4(*c*) show electric current supply arrangements for forming plating layers of predetermined thicknesses on the inner and rear sides of the half bearings. FIG. 4(*a*) shows the DC power source 15 for the inner surfaces and the DC power source 16 for the rear surfaces, and the outputs of the two power sources are adjusted so as to obtain the plating layers of predetermined thicknesses.

The arrangement of FIG. 4(*b*) is designed to form the plating layer only on the inner surfaces of the half bearings, and in this case the polarity of the DC power source for the reverse surfaces is inverted. This plating method of FIG. 4(*b*) is effective when there is an imperfect shield between the inner surfaces and rear surfaces of the half bearings. Also, when in connection with the ionization tendency of the components of the plating solution, metallic ions on the side of a precious metal in the plating bath tend to electrolessly deposit on the rear surfaces of the half bearings, the plating method of FIG. 4(*b*) effectively prevents this.

The arrangement of FIG. 4(*c*) is such that either of the power supplies of FIGS. 4(*a*) and 4(*b*) can be selected freely.

The present invention will now be illustrated in more detail by way of the following Examples:

EXAMPLE 1

Bearing-purpose aluminum alloy was press-bonded to a steel backing by roll pressure bonding, and then the thus bonded materials was subjected to annealing at 350° C. for 4 hours to provide a bimetal. Then, the bimetal was cut, shaped by pressing, and worked to thereby prepare half bearings of a semi-cylindrical shape each having an outer diameter of 56 mm, a width of 26 mm and a thickness of 1.5 mm. A tin surface layer of 5 μm thickness and a tin surface layer of 1 μm thickness were formed respectively on the inner and outer surfaces of the half bearings according to the following procedure:

The half bearings already subjected to the working were degreased by an ordinary solvent-degreasing method, and then were attached to a support member A in such a manner that the half bearings were arranged into a semi-cylindrical configuration as shown in FIG. 1. Then, in an ordinary automatic plating apparatus of the carrier type, the half bearings supported by the support member A were subjected to an alkali etching, an acid dipping, and a zinc immersion processing which were all known pretreatments to an aluminum alloy. Then, using the apparatus and method shown in FIGS. 2, 3 and 4(*a*), a nickel-lating layer of 0.1 to 0.3 μm thickness was formed on the inner surfaces of the half bearings in a conventional watt nickel plating bath (bath temperature: 50° C.; cathode current density: 1A/dm$^2$). Then, using the apparatus and method shown in FIGS. 2, 3 and 4(*a*), tin plating was also applied.

Components of the tin plating bath and the plating conditions are as follows:

| | |
|---|---|
| Tin sulfate | 60 g/l |
| Sulfuric acid | 100 ml/l |
| Gelatin | 2 g/l |
| β-Naphthol | 1 g/l |
| Bath temperature | 20° C. |
| Inner surface current density (Electrolysis time: 5 minutes) | 3 A/dm$^2$ |
| Reverse surface current density (Electrolysis time: 1 minute) | 3 A/dm$^2$ |
| Distance between the electrodes | 250 mm |

The thickness distributions of the tin plating layers of the finished bearings thus obtained according to the above method are shown in Table 1.

TABLE 1

| | | Thickness distribution*1 of tin plating layers (Unit: μm) | | | | | |
|---|---|---|---|---|---|---|---|
| | Measurement | Measurement positions*2 | | | | | Average |
| No. | surface | (a) | (b) | (c) | (d) | (e) | ($\bar{x}$) |
| (1) | Inner surface | 5.0 | 4.8 | 5.0 | 5.0 | 5.1 | 5.0 |
| | Reverse surface | 1.2 | 1.0 | 1.0 | 0.9 | 1.1 | 1.0 |
| (2) | Inner surface | 5.0 | 4.9 | 4.9 | 5.1 | 5.2 | 5.0 |
| | Reverse surface | 1.2 | 0.9 | 1.0 | 0.9 | 1.1 | 1.0 |

Figure 5A:
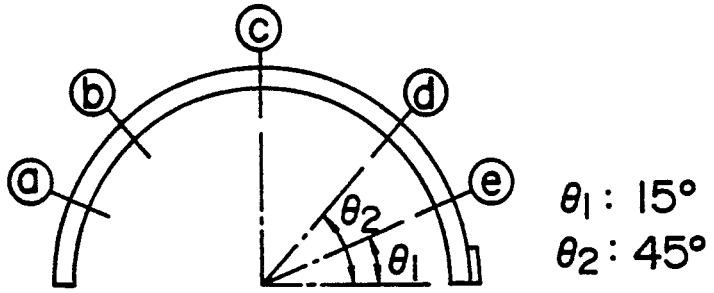
FIGS. 5A and 5B are respectively a schematic plan view and front-elevational views of half bearings, showing the positions of measurement of the plating thickness.
Figure 5B:
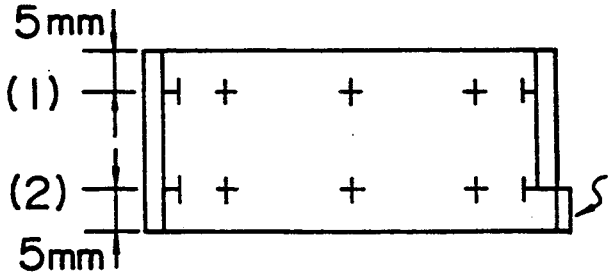

*1The measurement of th.: tin plating layers was effected by Kocou instrument (electrolysis film thickness gauge).
*2The measurement positions are shown in FIGS. 5A and 5B.

In this test example, although the predetermined thicknesses of the plating layers on the inner and rear surfaces were obtained by varying the plating time while using the same cathode current density, the thickness of each plating layer can be controlled by setting a value of an ampere-hour meter connected to the DC power source, while using the same current density.

EXAMPLE 2

A sintered layer (0.3 mm thick) of lead-bronze alloy (Cu-23 Pb-3.5 Sn) powder was formed on a steel backing to produce a bimetal. Then, the bimetal was cut, shaped by pressing, and worked to thereby prepare half bearings each having an outer diameter of 56 mm, a width of 26 mm and a thickness of 1.5 mm. Using the same plating conditions as in Example 1, a nickel plating layer of 1.5 μm thickness was formed on the inner surface of each half bearing, and further a lead alloy (Pb-10 Sn-2 Cu) surface layer of 20 μm thickness was formed thereon. Any plating was not electro-deposited at all on the rear surface of the half bearing.

Namely, eighteen (18) half bearings already subjected to the working were degreased by an ordinary solvent-degreasing method, and then were attached to a support member A in such a manner the half bearings were arranged into a semi-cylindrical configuration (having a length 480 mm equal to the height L of the support member A) as shown in FIG. 1. Then, using an ordinary automatic plating apparatus of the carrier type, the half bearings supported by the support member A were subjected to conventional electrolysis degreasing and an acid dipping. Then, using the apparatus and method shown in FIGS. 2, 3 and 4(*b*), a nickel-plating layer of 1.5 μm thickness was formed on the inner surfaces of the half bearings in a conventional watt nickel plating bath (bath temperature: 50° C.; cathode current density: 6A/dm$^2$). Then, using the apparatus and method shown in FIGS. 2, 3 and 4(*c*), lead alloy plating was further applied.

Components of the lead alloy plating bath and the plating conditions are as follows:

| | |
|---|---|
| Lead borate (as $Pb^{+2}$) | 100 g/l |
| Tin borate (as $Sn^{+2}$) | 8 g/l |
| Copper borate (as $Cu^{+2}$) | 2 g/l |
| Hydroboric acid | 80 g/l |
| Gelatin | 2 g/l |
| Bath temperature | 20° C. |
| Inner surface current density ($D_M$) (Electrolysis time: 15 minutes) | −2.5 A/dm$^2$ |
| Rear surface current density ($D_A$) (Electrolysis time: 15 minutes) | 0 to 0.5 A/dm$^2$ |

The thickness distributions of the lead alloy plating layers of the finished half bearings thus obtained according to the above method are shown in Table 2.

As is clear from Table 2, with respect to those of the half bearings whose rear surfaces were not energized, part of the DC current leaked from the inner surface to the rear surface to form stray current, and due to electroless deposition of the copper ions in the plating bath, a plating layer of 1 to 3 μm thickness deposited. However, in a case where the rear surfaces of the half bearings are disposed on the anode side while providing a counter electrode, when the current density is increased, no electroless deposition ceases to occur on the rear surfaces When the current value at this time is converted into a current density, this is 5 to 10% of the inner surface current density $D_K$. If it exceeds this value, the steel backing begins to be subjected to electrolytic corrosion, and the roughness is extremely increased at 15% of the current density $D_K$. Therefore, the rear surface current density $D_A$ was 5 to 10% (preferably, 5 to 7%) of the inner surface current density $D_K$.

TABLE 2

| No. | Reverse DA / Inner DK | × 100 (%) | Measurement surface | Measurement positions a | b | c | d | e | Roughness of rear surface (Rmax) |
|---|---|---|---|---|---|---|---|---|---|
| 1 | 0 | | Inner surface | 20.5 | 19.5 | 18.2 | 19.0 | 20.0 | 2.5 |
| | | | Rear surface | 2.8 | 1.5 | 0.5 | 1.5 | 2.5 | |
| 2 | 5 | | Inner surface | 21.0 | 20.1 | 19.5 | 20.0 | 20.5 | 2.5 |
| | | | Rear surface | 0.1 | 0 | 0 | 0 | 0 | |
| 3 | 10 | | Inner surface | 20.5 | 20.0 | 19.8 | 20.1 | 20.8 | 3.0 |
| | | | Rear surface | 0 | 0 | 0 | 0 | 0 | |
| 4 | 15 | | Inner surface | 19.8 | 20.0 | 19.5 | 20.0 | 19.5 | 9.5 |

TABLE 2-continued

| No. | Reverse DA / Inner DK | × 100 (%) | Measurement surface | Measurement positions a | b | c | d | e | Roughness of rear surface (Rmax) |
|---|---|---|---|---|---|---|---|---|---|
| | | | Rear surface | 0 | 0 | 0 | 0 | 0 | |

1) In order to precisely measure the thickness of the lead alloy plating layer, part of the plating layer at each measurement position was dissolved to form a step between the dissolved portion and the nondissolved portion, and this step was measured by a roughness gauge (longitudinal magnification: ×5000; lateral magnification: ×2).
2) The roughness of the rear surface was measured at the measurement position in the axial direction by a roughness gauge (longitudinal magnification: ×2000; lateral magnification: ×20).
3) The measurement positions were the same as in FIG. 5, but the axial position was the center.

The thickness of the nickel plating layer was measured by sampling inspection during the process. This thickness was 1.5 μm±0.1 μm, and therefore its explanation is omitted.

As described above, the method of the present invention does not require the exchange of the anode, and can be carried out by the use of the automatic plating apparatus, and also there is no need to transfer the box-like plating cases. Therefore, the apparatus can be of a compact size. Further, since the box-like plating cases do not need to be transferred, the plating solution is not brought out of the plating bath by such transfer of the plating case. Therefore, the present invention is very advantageous from the viewpoints of the plating case cost, anti-pollution, maintenance, and the overall installation costs, and besides high plating precision can be achieved as described above, and the plating and pretreatment can be freely applied to the inner and reverse surfaces. Thus, many other problems, in addition to the problems initially to be solved, can also be solved.

What is claimed is:

1. An electroplating apparatus for plating sliding bearings, comprising:

a plurality of plating tanks;

a plurality of plating cases each mounted within each of said plurality of plating tanks, respectively, each of said plating cases including a front abutment plate for facing inner surfaces of the half sliding bearings, and a rear abutment plate for facing rear surfaces of the half sliding bearings, said front abutment plate having a slit and a shield plate, said front and rear abutment plates being connected together at their one ends by a hinge;

an opening and closing device operatively connected to the other ends of said front and rear abutment plates so as to move said front and rear abutment plates toward and away from each other about said hinge to close and open said plating case; and a support member for supporting the half sliding bearings in such a manner that the half sliding bearings are arranged end-to-end into a semi-cylindrical configuration; said support member supporting the half sliding bearings being inserted into said plating case when said plating case is in its open condition.

* * * * *